United States Patent [19]

Ziegert

[11] Patent Number: 4,894,919

[45] Date of Patent: Jan. 23, 1990

[54] GARMENT PATTERN ADAPTATION SYSTEM

[75] Inventor: Beate I. E. Ziegert, Ithaca, N.Y.

[73] Assignee: Cornell Research Foundation, Inc., Ithaca, N.Y.

[21] Appl. No.: 194,175

[22] Filed: May 16, 1988

[51] Int. Cl.[4] ..... A41H 3/00

[52] U.S. Cl. ..... 33/17 R

[58] Field of Search ..... 33/17 R, 17 A, 2 A, 33/15, 14, 12; 2/243 R, 243 A, 243 B

[56] References Cited

U.S. PATENT DOCUMENTS

| | | | |
|---|---|---|---|
| 1,077,177 | 10/1913 | Vagas | 33/15 |
| 2,231,437 | 2/1941 | Cieri | 33/15 |
| 4,104,800 | 8/1978 | Dyal | 33/17 R |
| 4,114,277 | 9/1978 | Chalker | 33/17 R |
| 4,189,842 | 2/1980 | Alter | 33/557 |
| 4,205,446 | 6/1980 | Gibson | 33/17 R |
| 4,222,170 | 9/1980 | Koontz | 33/17 R |
| 4,293,959 | 10/1981 | Gioello | 33/17 R |
| 4,324,046 | 4/1982 | Weinberg | 33/17 A |
| 4,473,996 | 10/1984 | Kuroda et al. | 57/245 |
| 4,756,199 | 7/1988 | Merritt | 33/2 A |

OTHER PUBLICATIONS

Clothing and Textiles Research Journal, vol. 6 #4, Beate Ziegert and Geraldine Keil (date unknown).

*Primary Examiner*—William A. Cuchlinski, Jr.
*Assistant Examiner*—Christopher W. Fulton
*Attorney, Agent, or Firm*—Jones, Tullar & Cooper

[57] ABSTRACT

A garment pattern for action wearables is adapted for use with knitted elastomeric stretch fabrics. An original pattern suitable for rigid woven materials is initially modified to remove body ease and to reconfigure the pattern. This modified pattern is then a starting point for reductions in length and width which are dictated by the individual stretch characteristics of a particular knitted elastomeric fabric which will be used to make the finished garment. Pattern length and width reduction are applied to the modified pattern in a specific manner to arrive at the adapted stretch pattern.

8 Claims, 9 Drawing Sheets

GARMENT PATTERN ADAPTATION SYSTEM

FIELD OF THE INVENTION

The present invention is directed generally to a garment pattern adaptation system. More particularly, the present invention is directed to a garment pattern adaptation system which takes into consideration the individual stretch characteristics of a particular elastomeric knitted fabric. Most specifically, the present invention is directed to a system for adapting a pattern for action wearables in accordance with the individual stretch characteristics of the particular knitted elastomeric fabric from which the garment is to be made. The stretch capabilities of the particular fabric, in two directions, are determined and these characteristics are utilized to adapt a modified, or non-ease pattern to provide a stretch pattern. This stretch pattern can then be used to make well-fitting body contouring apparel from the particular knitted elastomeric fabric.

DESCRIPTION OF THE PRIOR ART

The development of elastomeric fibers over the last several decades has given new freedoms to textile and apparel producers and designers. These elastomers, such as spandex and the like, are characterized by high elongation and excellent elastic recovery. By using such elastomeric fibers, the textile industry has been able to produce knitted elastomeric fabrics which have particular utility in the manufacture of action wearables. Such garments as bathing suits, leotards, unitards and other body contouring apparel have become more in demand as a result of the increasing popularity of action sportswear and the consuming public's increasing concern with fitness and fashion.

The design and production of action wearables from knitted elastomeric fabrics has created significant problems in the adaptation of traditional garment patterns that were suitable for non-elastic woven fabrics. Such original patterns were developed to include a certain amount of excess material which was necessary with non-elastomeric or solid woven fabrics to provide the needed body or breathing ease. Such breathing ease is essential in woven fabric garments to allow the wearer sufficient material to be able to move comfortably and in a non-restricted manner. When action wearables are to be produced from knitted elastomeric fabrics, the original pattern, intended for use with a rigid woven fabric, must be adjusted or adapted to allow the production of body contouring apparel which is both well fitting and fashionable.

Various prior art techniques have been utilized in attempting to design action wearables and other garments utilizing modern knitted elastomeric fabrics. These have included draping each fabric on existing dress forms; reducing conventional original patterns intended for rigid woven materials to remove body ease; and relating skin stretch measurements to fabric stretch. All of these prior attempts to create patterns which are useable with knitted elastomeric stretch fabrics have not been particularly successful and have not provided a viable approach to the design and production problems created by these fabrics which are currently available.

Draping of fabrics onto a dress form is a hand skill. Since the amount of tension which each individual's hand applies to the fabric as it is manipulated over the dress form cannot be measured, the results are widely variable. Hand draping of elastomeric fabrics over a dress form to produce a master garment which can be used to generate a pattern for similar garments is an inconsistent, time consuming and costly procedure. Further, since stretch characteristics of fabrics are apt to vary from lot to lot or from bolt to bolt, a pattern that may have been suitable for one piece of material may well not be acceptable for use with another.

Merely reducing an original pattern, which was intended for use with a woven rigid or non-elastomeric fabric, to remove body ease is also not an acceptable solution. This process does not consider the stretch factors of each individual fabric and may distort the finished product in key areas. Various stretch gauges are sold by pattern companies but they provide only a rough means for determining fabric stretchability since they identify only four general categories of stretch fabrics.

Garments made of woven stretch fabrics have been tested for their ability to fit the human body in a non-constricting manner while stretching to accommodate for body movement. The stretchability of skin can be related to stretchability of fabric, but the two are not identical. Knitted elastomers are recommended by the textile industry for the production of body contouring apparel which demand stretchability, comfort, non-constriction, and good fit. Information on how to test each fabric for its unique stretch characteristics is insufficient. Since most knitted elastomers have differing course and wale stretch capabilities, the influence of the utilization of fabric direction on finished garments is crucial to the garment's fit. Yet, conflicting information exists with regard to the utilization of the direction of a fabric's maximum stretch.

The inaccuracy of the prior methods and devices for use in adaptation of original woven rigid fabric patterns to produce stretch patterns useable with knitted elastomeric stretch fabrics together with the wide range of currently available stretch fabrics which have significantly varying stretch characteristics in both warp and weft directions, as well as overall differences, clearly indicate that a new garment pattern adaptation system, to effectively use knitted stretch fabrics, is needed. The garment pattern adaptation system of the present invention provides a highly successful way of adapting patterns for use with these modern stretch fabrics.

SUMMARY OF THE INVENTION

It is as object of the present invention to provide a system of garment pattern adaptation.

Another object of the present invention is to provide a system of garment pattern adaptation for stretch fabrics.

A further object of the present invention is to provide a system for garment pattern adaptation which utilizes the particular stretch characteristics of each individual stretch fabric.

Yet another object of the present invention is to provide a system for garment pattern adaptation which includes a device to measure the stretchability of any elastomeric fabric.

Still a further object of the present invention is to provide a system for garment pattern adaptation which includes modifying flat patterns for woven rigid materials.

Even yet another object of the present invention is to provide a system for garment pattern adaptation suitable for use by both manufacturers and non-commercial users.

As will be discussed in greater detail in the description of the preferred embodiment which is set forth subsequently, the present invention provides a system including both apparatus and a method for determining the particular stretch characteristics of any individual fabric and for adopting a modified or non-erase pattern by application thereto of stretch factor reduction units determined by the particular fabric's individual stretch characteristics to arrive at a stretch fabric pattern which can be used to produce action wearables from knitted stretch elastomeric fabrics. The stretch characteristics of any particular elastomeric fabric are determined in the directions of both courses and wales. These stretch capabilities are then utilized to arrive at a stretch factor reduction by which the pattern is reduced in size. This stretch factor reduction is applied to front and back pattern quarters in similar methods for each pattern portion. The stretch pattern, which is the result of the application of the stretch factor reduction to the modified pattern, is then used to produce action wearables which are well fitting, and which move with the person.

The system for garment pattern adaptation in accordance with the present invention is significantly different from the prior attempts made to adapt patterns for use with knitted stretch fabrics. The particular stretch characteristics of each individual fabric are accurately ascertained for both directions of fabric stretch. This is in contrast to the prior hand draping approach in which the tension applied to the fabric, as it was applied by hand to the dress form, was an individual, and thus widely changeable, variable. The empirical determination of the fabric's ability to stretch, and the use of this fabric stretch characteristic expressed as a fabric stretch percentage, overcomes the inconsistency inherent in a hand draping procedure.

Once the stretch percentages have been ascertained in both the course and wale directions of a particular fabric, these values are utilized to arrive at specific stretch factor reduction units. These units are, in turn, applied to a pattern, which has been previously modified to remove body ease, to arrive at a final stretch fabric pattern. Thus in contrast with prior art solutions which merely took an original pattern intended for use with woven rigid fabrics and removed body ease material, the garment pattern adaptation system of the present invention creates a modified pattern which removes body ease and which also adjusts the pattern since it will be used with stretch elastomeric fabrics, and then further adapts this modified or non-ease pattern based on the particular stretch characteristics of the individual fabric to be used to arrive at a stretch pattern. As may be appreciated, this stretch pattern, which is the end point of the present invention, can then be used to manufacture, either on a large scale or on an at home basis, various action wearables such as leotards, unitards, swimwear and the like. These garments are far superior in fit, appearance and in their ability to allow non-constrictive movement of the wearer than the prior garments produced by using patterns modified only to remove body ease ever could be.

The system of garment pattern adaptation in accordance with the present invention provides a unified solution to the problem of adapting original patterns intended for use with woven rigid materials to stretch patterns which are sized to more effectively utilize the particular stretch characteristics of individual fabrics. It provides a significant advance in the art which affords a substantial improvement in the styling, production, appearance and fit of action wearables made from stretch elastomeric fabrics.

BRIEF DESCRIPTION OF THE DRAWINGS

While the novel features of the garment pattern adaptation system in accordance with the present invention are set forth with particularity in the appended claims, a full and complete understanding of the invention may be had by referring to the description of the preferred embodiment which is set forth subsequently, and as illustrated in the accompanying drawings in which:

DESCRIPTION OF THE PREFERRED EMBODIMENT

Knitted stretch elastomeric fabrics are made by a large number of manufacturers in a wide range of blends of synthetic materials, such as nylon, with varying percentages of elastic materials, such as spandex and the like. A fabric's ability to stretch is determined by a number of variables, such as fiber content, yarn texturing and its fabrication structure. These knitted stretch elastomeric fabrics are all intended for use in the production of action wearables by their producers. However, until the advent of the present garment adaptation system, there has not been a satisfactory system for adaptation of a pattern originally intended for use with rigid woven fabrics to use with a particular knitted stretch elastomeric fabric having individual stretch capabilities in two directions.

Figure 1:
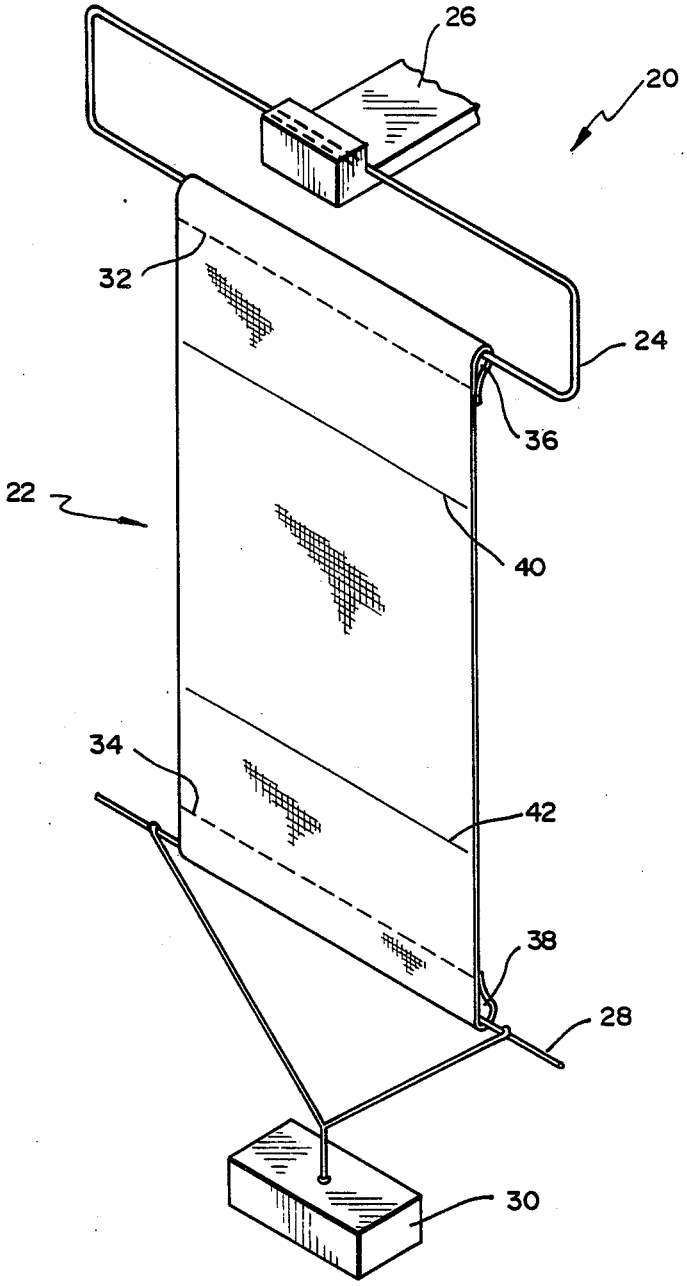
FIG. 1 is a perspective schematic view of a stretch fabric sample and apparatus for determining fabric stretch.

A first step in the garment pattern adaptation system of the present invention is to accurately determine the stretch characteristics of a particular knitted elastomeric fabric. Referring to FIG. 1, there may be seen an apparatus, generally at 20 for determining the stretch characteristics of a fabric sample generally at 22. Garment stretch test assembly 20 may include an upper hanger 24, which may be secured to a suitable upper support 26, and a lower rod 28 to which is removably attached a suitable weight 30. In the preferred embodiment, weight 30 is a 500 gm weight. It will be understood that the stretch fabric garment test apparatus 20 shown in FIG. 1 could be used both by commercial and non-commercial gament makers and is easily constructed from materials available in the home.

In use, fabric samples 22 are cut from each of the two grain direction of the stretch fabric to be tested. Thus one sample is cut so that its major dimension is across the fabric in the course or weft direction, while the other sample is cut so that its major dimension is along the fabric in the wale or warp direction. Each fabric sample is cut to have an overall length of 40 cm and a width of 20 cm. Then, as may be seen in FIG. 1, each sample 22 is provided with an upper hem 32 and a lower hem 34. These hems form upper and lower pockets 36 and 38 which receive upper hanger 24 and lower rod 28, respectively. Further, the fabric, before it is tested is marked with upper and lower benchmarks 40 and 42 respectively. These benchmarks are each spaced 10 cm from the center of the test fabric and provide a test area of 20 cm by 20 cm. This size of the test fabric is a departure from prior art systems which typically utilized a narrow fabric sample having a tubular shape. In contrast, the sample shape in accordance with the present invention has a 20 cm by 20 cm size since this approximates the size of one quarter of a human body pattern for a garment having a size 10, and which measures approximately 23 cm from center front to side seam. Furthermore, typical vertically spaced guidelines on a size 10 active wear pattern are approximately 20 cm apart. Thus a test sample having a 20 cm by 20 cm size is directly related to the one quarter dimension of the garment pattern which will be produced.

Each fabric sample 22 was placed on the fabric stretch test apparatus 20 and a 500 gram weight was attached for a time of 30 minutes. The fabric elongation between the upper and lower benchmarks 40 and 42 was then measured. The percentage of fabric stretch was then determined using the following formula:

$$\% \text{ FABRIC STRETCH} = 100\,[(C-A)/A]$$

where:

A = distance between benchmarks prior to extension; and

C = distance between benchmarks under load.

As may be seen from Table 1, the stretch percentages vary widely from sample to sample in the course and wale direction and also in total stretch, the sum of the two stretch percentages. This variation occurs in fabrics having generally similar materials. Additionally, fabrics having similar overall stretch capabilities, such as fabrics 1, 2, 3, 4 and 10 may have quite different course and wale stretch elongation percentages.

TABLE 1

FABRIC STRETCH TEST RESULTS

| Fabric | % Nylon/ Spandex Fiber Content | Measurement in Stretched Position: Across the Fabric Courses/ Weft | Measurement in Stretched Position: Elongation Percentage in Stretched Position | Measurement in Stretched Position: Along the Fabric Wales/ Warp | Measurement in Stretched Position: Elongation Percentage in Stretched Position | Sum of Column 2 and 4 Stretch Factor |
|---|---|---|---|---|---|---|
| 1 | 85 Nylon 15 Spandex | 22.4 | 12.0 | 23.6 | 18.0 | 30. |
| 2 | 84 Nylon 16 Spandex | 21.6 | 8.0 | 24.6 | 23.0 | 31. |
| 3 | 85 Nylon 15 Spandex | 23.2 | 16.0 | 23.1 | 15.5 | 31.5 |
| 4 | 83 Nylon 17 Spandex | 22.6 | 13.0 | 23.5 | 17.5 | 30.5 |
| 5 | 77 Antron 23 Spandex | 24.0 | 20.0 | 30.4 | 52.0 | 72. |
| 6 | 82 Antron 18 Spandex | 26.5 | 32.5 | 26.0 | 30.0 | 62.5 |
| 7 | 81 Antron 19 Spandex | 27.5 | 31.5 | 26.5 | 32.5 | 75. |
| 8 | 53 Antron 7% Stretch Nylon 40% Spandex | 25.4 | 27.0 | 23.5 | 17.5 | 44.5 |
| 9 | 84 Antron 16 Spandex | 22.1 | 12.5 | 24.2 | 21.5 | 31.5 |
| 10 | 51 Antron 49 Spandex | 23.7 | 18.5 | 22.7 | 13.5 | 32. |
| 11 | 72 Antron 28 Spandex | 28.6 | 43.0 | 25.3 | 26.5 | 69.5 |
| 12 | 70 Nylon 30 Spandex | 21.9 | 9.5 | 21.3 | 6.5 | 16. |
| 13 | 80 Nylon 20 Spandex | 24.6 | 23.0 | 23.4 | 17.0 | 40. |
| 14 | 81 Antron 19 Spandex | 24.3 | 21.5 | 22.7 | 13.5 | 35. |

The fabric stretch test results set forth above demonstrate clearly that a fabric's stretch characteristics cannot be determined solely by knowledge of its elastomeric fiber content. Fabrics 4 and 6 in Table 1 illustrate just how disparate this relationship can be. Fabric 4 is composed of 17% spandex fiber and fabric 6 of 18% Spandex. The difference in spandex fiber contents is only one percent, yet their total stretch percentages are 30% and 62.5% respectively. Fabric 6 has more than twice the stretch characteristics of fabric 4. Fabrics 11 and 12 illustrate again how fiber content alone is not an accurate indicator of a fabric's stretch characteristics. The percentage of spandex in each of these fabrics is fairly equal at 28% for fabric 11 and 30% for fabric 12. In this case their total stretch percentage, as determined by the fabric stretch test, differs by 53.5%, that is 69.5% for fabric 11 and 16% for fabric 12.

The fabric stretch test demonstrates further that a fabric's overall stretch percentage does not give an accurate enough picture of that fabric's specific stretch characteristics. Table 1 illustrates how different course and wale stretch percentages can produce similar totals. Fabrics 5 and 11 stretch fairly equally at 72% and 69.5% respectively, a difference of only 2.5%, yet their course and wale stretch percentages vary considerably. The course stretch of fabric 5 is 20% and that of fabric 11 is more than double at 43%. The wale stretch of fabric 5 is 52% and is nearly double that of fabric 11 at 26%. Such differences in specific course and wale stretch characteristics need to be considered in order to produce well fitting garments. It is therefore necessary to utilize the present garment adaptation system to enable the data collected from the fabric stretch tests to be applied to garment forms.

Once the particular fabric stretch percentages for an individual stretch elastomeric fabric have been determined by use of the fabric stretch test of the present invention, it then is necessary to adapt a garment pattern in accordance with these particular characteristics. This is accomplished in the present invention by starting with a pattern originally intended for use with woven non-elastic fabrics; by changing this pattern to arrive at a modified or non-erase pattern suitable for use as a starting point for all stretch fabric patterns; and by then applying particular stretch elongation values for an individual fabric to the modified pattern to arrive at a stretch pattern which can be used to produce action wearables that utilize the particular fabric.

Figure 2A:
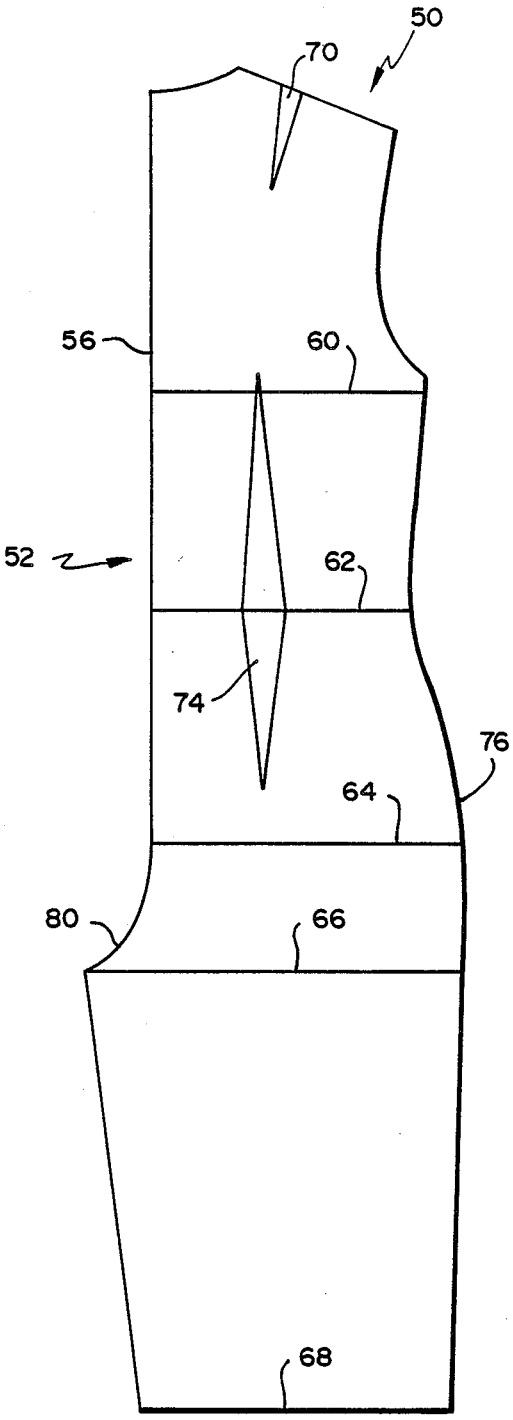
FIG. 2A (PRIOR ART)
FIGS. 2A and 2B are a lay out view of an original prior art pattern for one half of a torso bodice and pant shell.
Figure 2B:
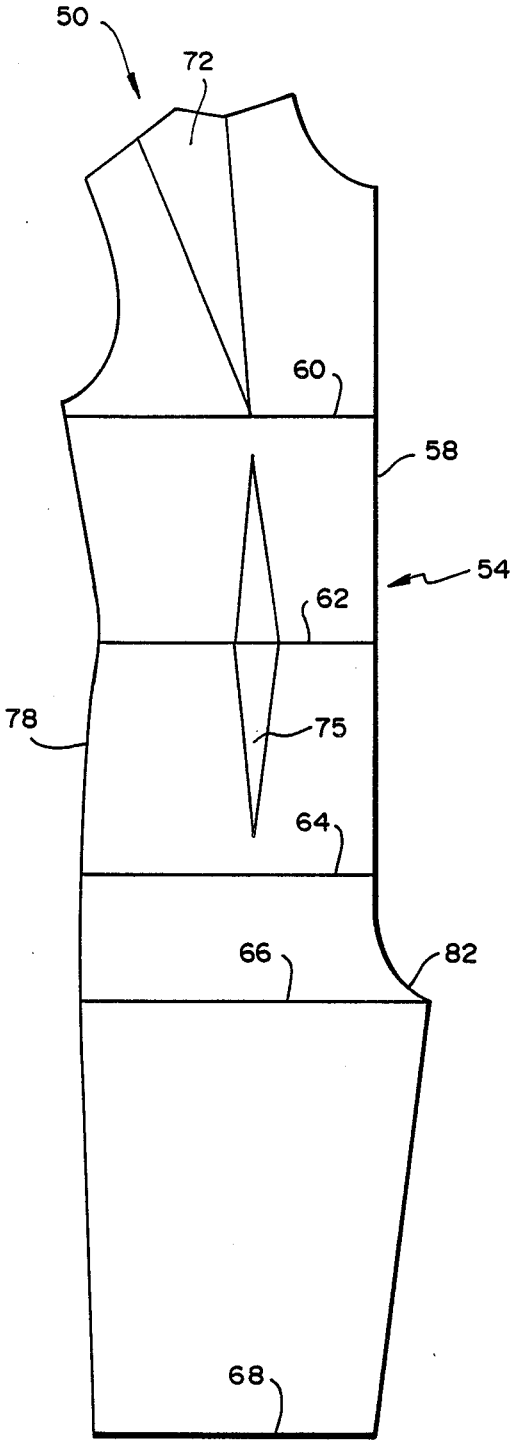
FIG. 2B (PRIOR ART)

Referring now to FIGS. 2A and 2B there may be seen generally at 50 an original or conventional prior art pattern lay out which may be used to produce a leotard-like garment having a torso bodice and combined pant shell. This pattern arrangement, as is known by one of skill in the art, is useable to produce one half of a garment. The pattern 50 has various lines and points which will be numbered similarly in this and succeeding drawings. Pattern 50 has a back side portion 52 and a front side portion 54. Back side portion 52 has a center back line 56 while front side portion 54 has a center front line 58. Both pattern portions have cooperating bust lines 60, waist lines 62, hip lines 64, crotch lines 66, and knee lines 68. Since this original pattern 50 is intended for use with woven rigid fabrics such as muslin and the like, it also includes back and front shoulder darts 70 and 72, a rear torso dart 74 and a front torso dart 75. These darts provide enough material to allow sufficient body or breathing ease so that the garment produced from a rigid woven fabric will allow the wearer a moderate amount of freedom to move and breath.

The original pattern 50 of FIGS. 2A and 2B is initially reduced along the back and front sideseams 76 and 78 and at the crotch inseams 80 and 82 to remove body ease since the finished garment will be made from a stretch material instead of a rigid non-elastic fabric. Additionally the distance from the waist 62 to crotch 66 is shortened. These changes result in a first modified pattern as shown at 84 in FIGS. 3A and 3B. The original pattern of FIGS. 2A and 2B is shown in dashed lines in FIGS. 3A and 3B for ease in noting the reduction in pattern size. Next the original pattern 50, which has been modified as discussed above, is further modified for use with knitted elastomeric fabrics by redistributing the body shaping elements or darts, such as the back and front shoulder darts 70 and 72, and the rear and front torso darts 74 and 75. These modifications are shown more clearly in FIGS. 4A and 4B and result in a final modified or non-ease pattern, generally at 90. The back shoulder dart 70 is realigned at the armhole as seen at 92 while the front shoulder dart 72 is redistributed so that one-third is transferred to the neckline at 94 while two-thirds are redistributed to the front section armhole, as shown at 96. This bust shaping front shoulder dart 72 which is found in woman's wear can be separated in this manner when using elastomeric fabrics since the fabric has sufficient stretch capabilities to stretch adequately over the bust. This quantification of the bust dart 72 and its distribution is a result of an appreciation of how the human form expands and moves during exercise. The back torso dart 74 is eliminated by a redistribution of 75% of the original dart between the center back seam 56 and the rear side seam 76. The front torso dart 75 is eliminated by redistribution of 75% of the original dart to the front side seam 78. In redistributing these torso darts, 25 percent of the original dart is retained to allow for body movement, to avoid fabric distortion, and to provide a well fitting garment.

Figure 3A:
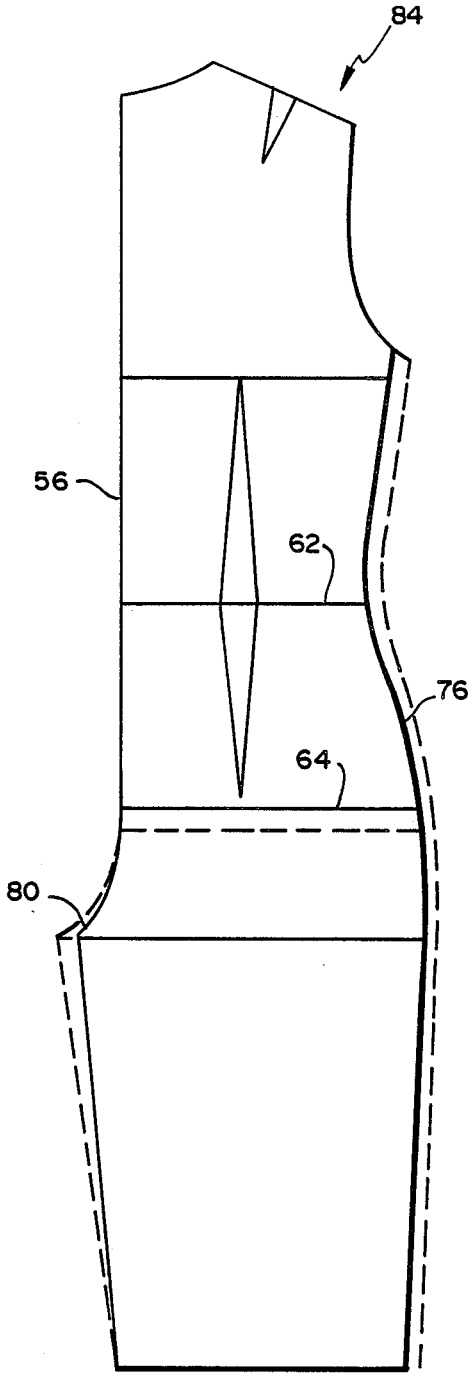
FIGS. 3A and 3B are a lay out view of the pattern of FIGS. 2A and B with body ease removed.
Figure 3B:
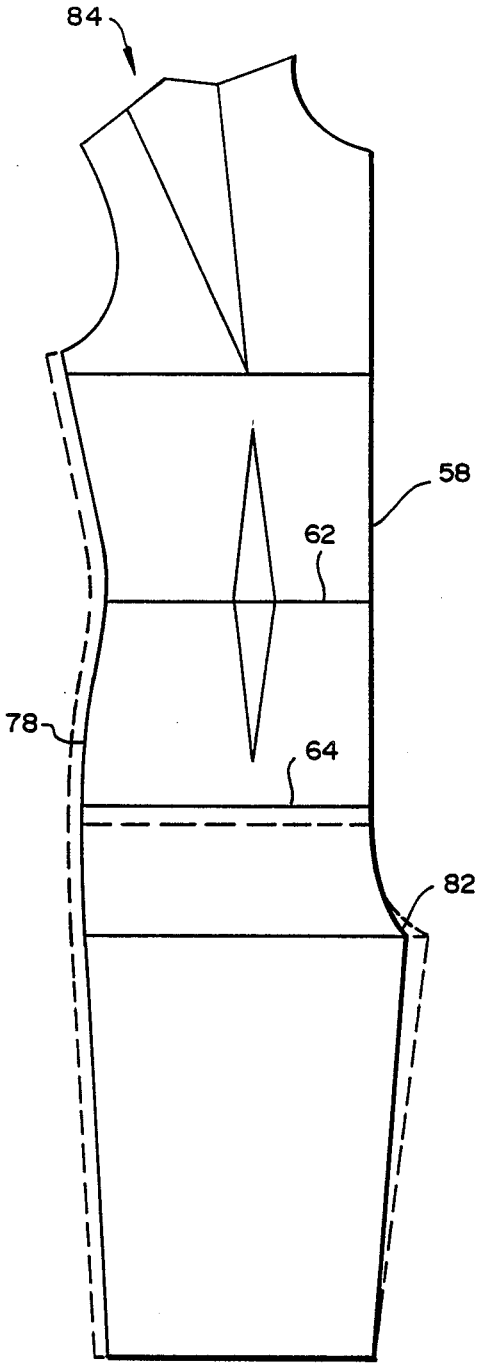
Figure 4A:
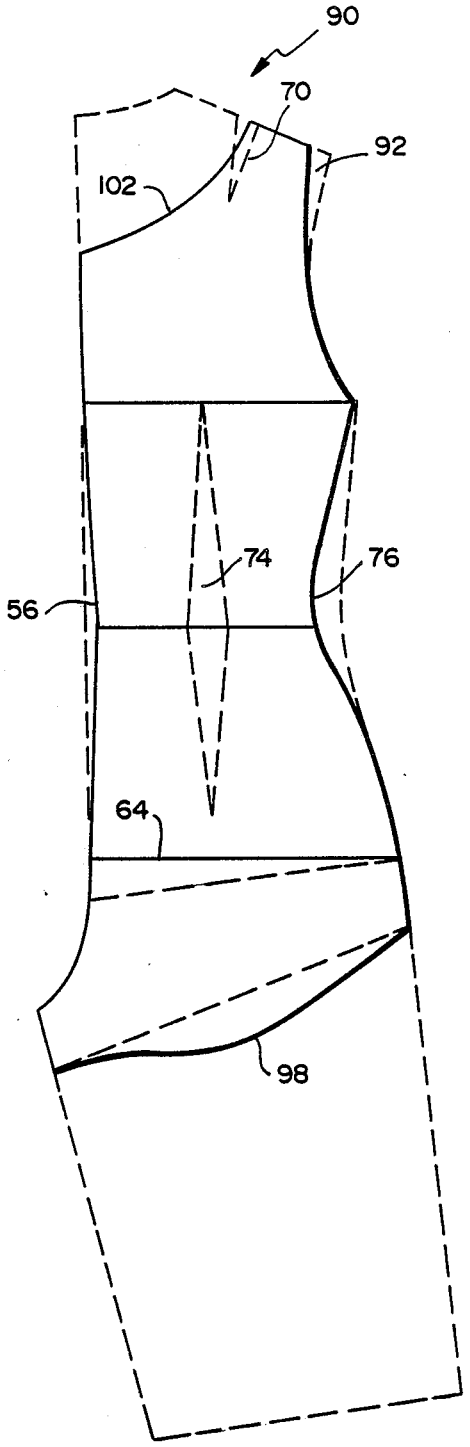
FIGS. 4A and 4B are a lay out view of the pattern of FIGS. 3A and B showing a lowered neckline, dart realignment and crotch and leg development.
Figure 4B:
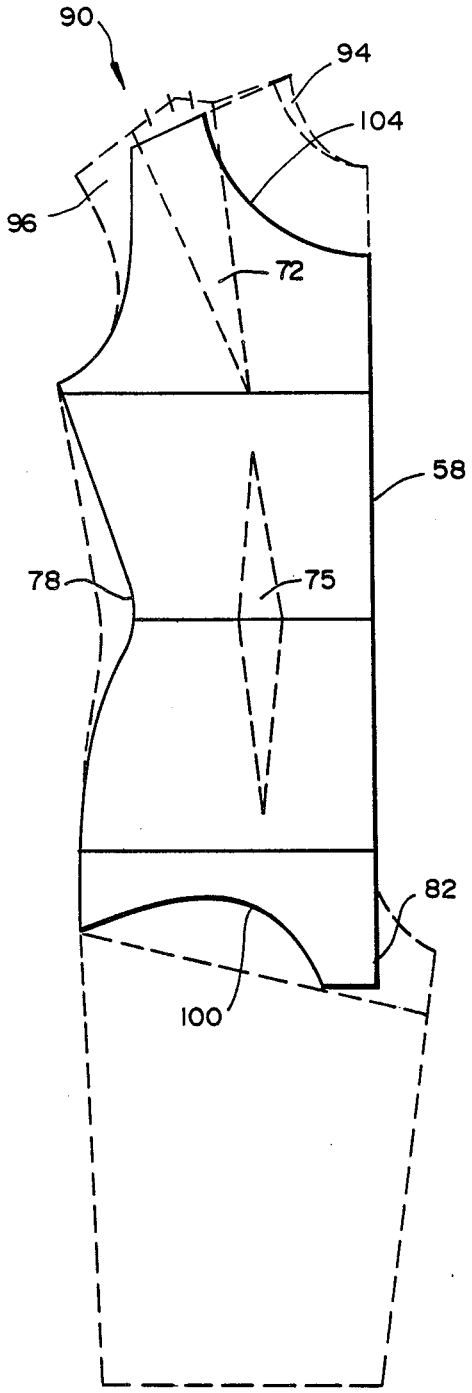

The first modified pattern 84 of FIGS. 3A and 3B is also modified, as seen in FIGS. 4A and 4B, to arrive at final modified pattern 90 by lengthening the torso by generally about 3 cm at the back hip line 64 to accommodate for the elongation which occurs when the human form sits down. This elongation occurs in the general area between the waist to the point just beneath the lower buttocks area and the lengthening is applied at the hipline. As may also be seen in FIGS. 4A and 4B, the leg portion of the original pattern 50 may be removed, and leg openings 98 and 100 added. Additionally, the front crotch line 82 may be straightened and pivoted to produce a straight center front line 58. Further, if desired, the back and front necklines 102 and 104, respectively may be lowered. This is not essential to the development of the final modified pattern 90 but is done, if desired.

Figure 5A:
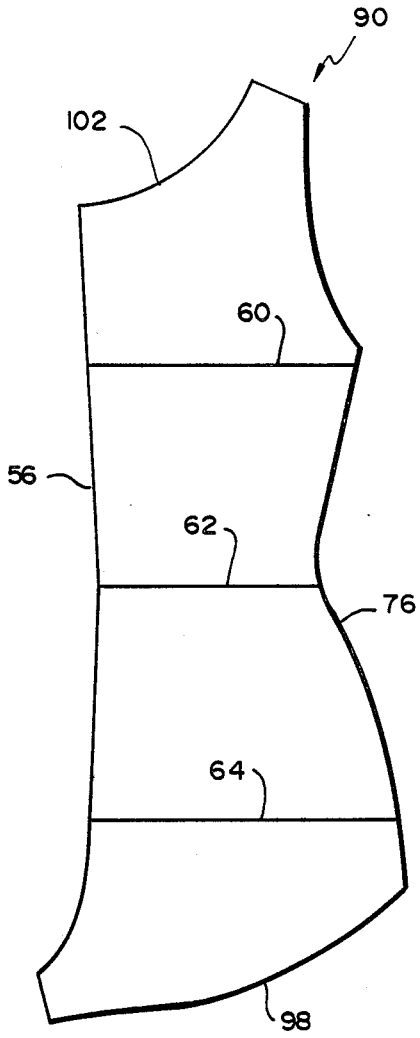
FIGS. 5A and 5B are a lay out view of a modified garment pattern in accordance with the present invention.
Figure 5B:
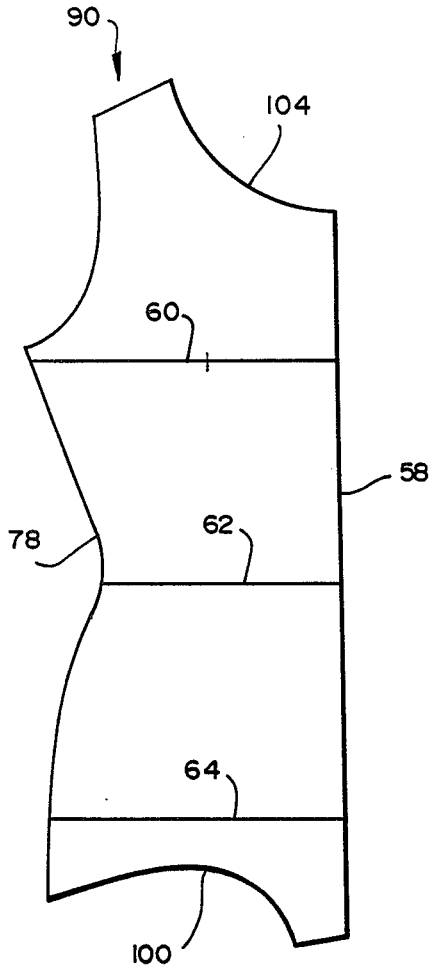

The final modified, or non-ease pattern 90 may be seen most clearly in FIGS. 5A and 5B and, as compared with the original pattern 50 shown in FIGS. 2A and 2B is substantially changed by the removal of body ease and body shaping portions. This modified pattern 90 is still designated for woven fabric but has lost the body shaping elements needed for body contouring garments constructed from woven fabrics. It is also not suitable as a final pattern for elastomeric fabrics, because adjustments for the fabric's stretch factor have not been made. Compared to the original pattern for woven fabrics, this modified pattern is narrower and shorter, although the back has been necessarily lengthened to provide for extreme vertical body movement. It could not be used to produce a wearable garment from a woven material since it would fit the wearer in a manner tighter than a second skin. However, this modified pattern in accordance with the present invention will now serve as a basis for use in applying the individual stretch characteristics of a particular knitted elastomeric fabric to the modified pattern 90 to arrive at a final stretch pattern.

Figure 6A:
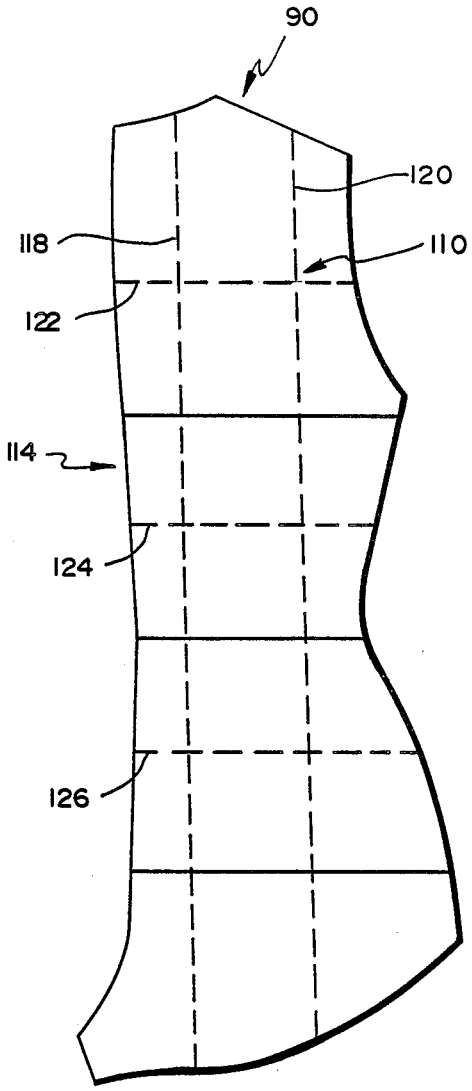
FIGS. 6A and 6B are a lay out view of the modified garment pattern of FIGS. 5A and 5B and showing a gridwork system used to adjust the modified pattern for fabric stretch.
Figure 6B:
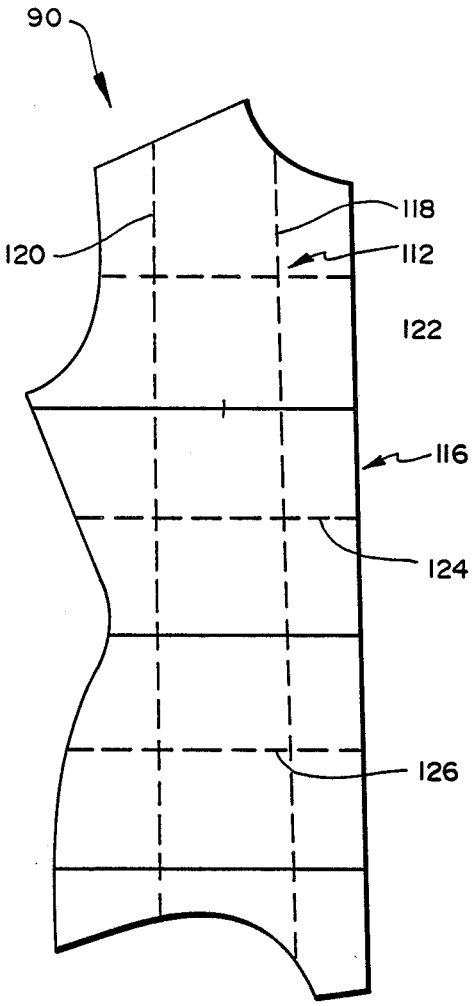

Turning now to FIGS. 6A and 6B, a gridwork generally at 110 is applied to rear back portion 114 of modified pattern 90 while a similar gridwork 112 is applied to front side portion 116 of modified pattern 90. In the past, gridwork systems have been used in the garment industry to increase or decrease the size of apparel forms for body size differences. In contrast, in the present invention, the gridwork system is used to adapt the modified pattern form 90 for differences in fabric stretchability. The two gridwork arrays 110 and 112 are each formed by spaced center and side vertical lines 118 and 120, and by upper 122, mid 124 and lower 126 horizontal grid lines. Stretch factor reductions, as determined based on fabric stretch percentages in a manner to be discussed shortly, are applied to these grids to reduce the size of the modified pattern 90. Any adjustments made at the two vertical grid lines 118 and 120 will reduce the width of the pattern while changes made at the three horizontal grid lines 122, 124, and 126 will reduce the length of the pattern.

Figure 7A:
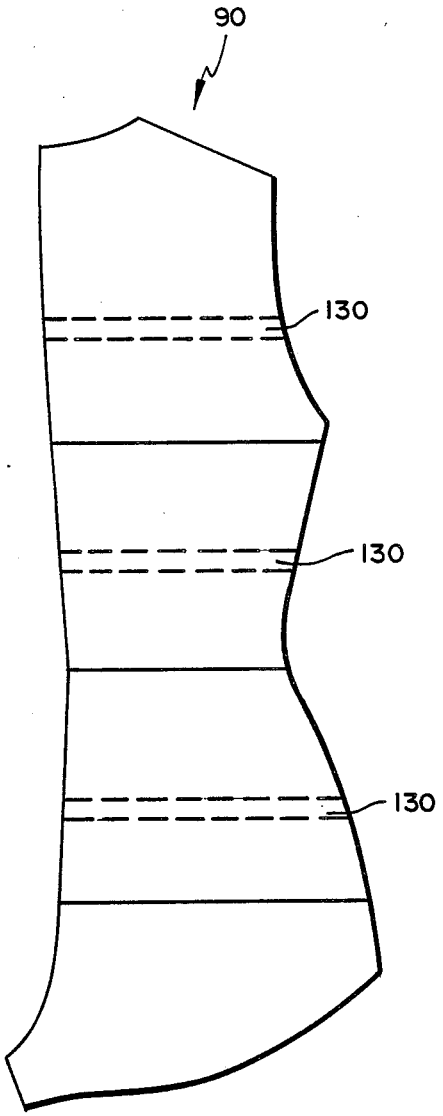
FIGS. 7A and 7B are a lay out view of the modified pattern and showing areas of length reduction in accordance with fabric stretch characteristics.
Figure 7B:
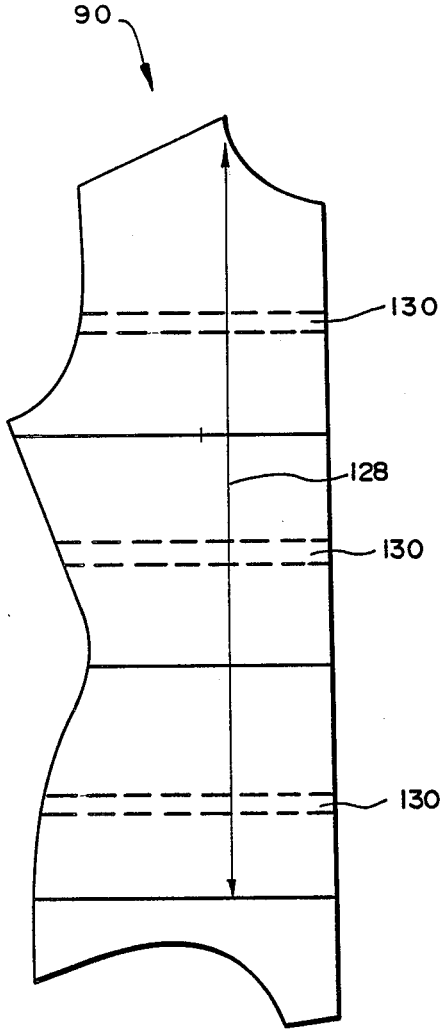
Figure 8A:
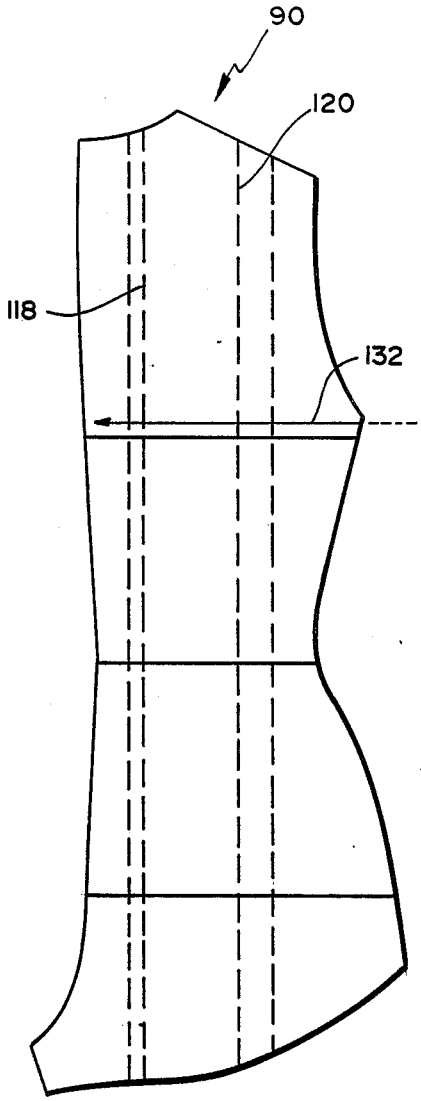
FIGS. 8A and 8B are a lay out view of the modified pattern and showing areas of width reduction in accordance with fabric stretch characteristics.
Figure 8B:
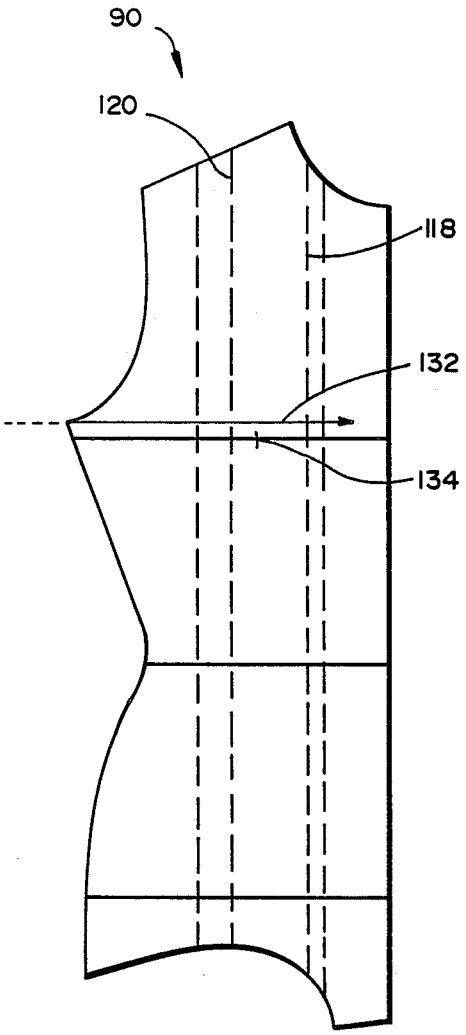

The specific length and width reductions to be applied to the gridworks 110 and 112 of modified patterns 90 are determined by utilizing the particular percentages of fabric stretch, as determined by the fabric stretch test results for that individual fabric through the application of two formulas. The total length reduction factor is determined by multiplying the distance 128 from the neck to the hip, as seen in FIG. 7B by the higher, or lower of the fabric stretch percentages. This total pattern length reduction amount is then divided by a factor of 2 to provide a finished garment which contours the body while still leaving sufficient ease for body movement. This resulting reduction amount is then allocated into three equal horizontal reduction units 130 which are applied to the three horizontal grid lines 122, 124 and 126 to reduce the length of the modified pattern 90 as shown in FIGS. 7A and 7B. In a similar manner, the total width reduction is determined by multiplication of the pattern width from center back seam to the center front seam at bust level as indicated at 132 in FIGS. 8A and 8B by either the lower or higher of the fabric stretch percentages. This results in a half body width reduction. This half body width reduction is reduced by a factor of 2 to allow suitable body contouring while providing sufficient reserve stretch in the fabric to provide adequate body ease. This resultant half body width reduction is then again divided in half to provide a quarter body reduction value which can be applied to each pattern piece. The resultant quarter body width reduction unit is then unevenly applied to the two spaced vertical grid lines 118 and 120 for each pattern piece. As may be seen most clearly in FIGS. 8A and 8B, three fourths of each quarter body width reduction unit is applied to the modified pattern 90 along the side vertical grid lines 120 while only one fourth of each quarter body width reduction unit is applied to the modified pattern 90 along the center vertical grid lines 118. This unequal division of the quarter body width reduction avoids garment distortion of the neckline area of the garment and also takes into account the fact that a person's body expands and contracts more from the bust point 134 to the side than it does between bust points. This unequal distribution of the body width reduction unit thus properly locates the width reductions at the proper areas.

It is important at this point to note that the same fabric stretch percentage is not used in both the length and width reduction calculations. One; i.e., the higher or lower is used in one calculation, while the other; i.e., the lower or higher is used in the second calculation. Thus the final stretch pattern has been adjusted in one direction to reflect one directional stretch characteristic of the fabric and in the other direction to reflect the other stretch characteristics of the fabric.

The length and width reduction formulas may be set forth as follows:

Length Reduction Formulas (LRF)

(1) $X.C=Z$ (1a) $(Z\div 2)\div 3=H$

Where:

X=Distance 128 from neck to hip

C=Higher or lower % of fabric stretch as determined by fabric stretch test

Z=Total pattern length reduction

H=Horizontal reduction unit used in each of 3 locations 130 on pattern

Width Reduction Formulas (WRF)

(2) $Y.W=T$ $(T\div 2)\div 2=V$ (2a)

$(V\div 4)=P$ $P\cdot 3=Q$

Where:

Y=Distance 132 from center front to center back at the bust level

W=Lower or higher % of fabric stretch as determined by fabric stretch test

T=Half body width reduction

V=Total reduction for each $\frac{1}{4}$ body

P=Neck/hip reduction unit 118

Q=Shoulder/hip reduction unit 120

The modified leotard pattern 90 of FIGS. 5A and 5B may now be adapted for use with a particular stretch fabric by utilization of the above length and width reduction units as discussed with FIGS. 7A and B and 8A and B. In use, as may be seen by referring to the following Table 2, the stretch percentages for fabrics 7 and 9 of Table 1 were used to arrive at specific length and width reduction units. In determining these length and width reduction units, the distance x is 57.05 cm and the distance y is 42.04 cm. As indicated above, these distances are taken from the final modified or non-ease patterns.

TABLE 2

| Formulas | Fabric # | Reduction Formulas applied to Garment Construction: Stretch Value | Wales & Courses on Fabric | Direction of Fabric Grain on Garment | Garment No. | Reduction Units |
|---|---|---|---|---|---|---|
| LRF | 7 | LS % | Wales | ↕ | $I^7$ | H = 3.09 cm |
| WRF | 7 | HS% | Courses | ↔ | $I^7$ | P = .98 cm<br>Q = 2.94 cm |
| LRF | 7 | HS % | Courses | ↕ | $II^7$ | H = 3.56 cm |
| WRF | 7 | LS% | Wales | ↔ | $II^7$ | P = .85 cm<br>Q = 2.56 cm |
| LRF | 9 | LS % | Courses | ↔ | $III^9$ | H = .99 cm |
| WRF | 9 | HS% | Wales | ↕ | $III^9$ | P = .55 cm<br>Q = 1.65 cm |
| LRF | 9 | HS % | Wales | ↔ | $IV^9$ | H = 1.99 cm |
| WRF | 9 | LS% | Courses | ↕ | $IV^9$ | P = .27 cm<br>Q = .81 cm |

Key to TABLE 2
LRF: Length Reduction Formula
WRF: Width Reduction Formula
LS: Lower Stretch Percentage
HS: Higher Stretch Percentage
H: horizontal reduction unit
P: neck/hip reduction unit
Q: shoulder/hip reduction unit Fabrics 7 and 9 have been utilized to illustrate the system for adapting the modified leotard pattern for individual fabric stretch characteristics. Although the spandex content of fabrics 7 and 9 are similar at 19% and 16%, respectively, their total combined stretch percentages are not. Fabric 7's total stretch percentage of 70 is more than double that of fabric 9 at 31.5. The course stretch percentage of fabric 7 is 37.5%, more than three times the course stretch percentage of fabric 9 which is 10.5. But, their wale stretch percentages are less dissimilar; the wale stretch percentage of fabric 7 is 32.5 and that of fabric 9 is 21.

If one were to consider only the total stretch percentage of those fabrics when constructing a garment, the end results in terms of shape and fit would be inconsistent. Because of the differences in the wale and course stretch percentages, the direction of wale or course straight grains would have a definite effect upon the end product.

Table 2 shows the results of the length and width reduction calculated for fabrics 7 and 9 of the fabric stretch test. The wale and course stretch percentages of both fabrics were calculated with those formulas. The resulting diverse reduction units for H, P and Q were specific to each fabric and, more importantly, to both grain directions of each fabric. The modified leotard patterns 90 then were reduced at the grid lines using those reduction units.

FIGS. 9, 10, 11 and 12 illustrate the various reduction alterations made to each of the four front pattern pieces and compared to the starting modified pattern 90. The larger solid outline in FIGS. 9, 10, 11 and 12 represents the modified pattern 90 before reduction formulas LRF and WRF were applied. Bold and dotted lines with arrows at each end indicate grain direction and correspond to the bold and dotted outlines of pattern pieces. For comparison, all patterns are aligned on the waistline and along the center front.

Figure 9:
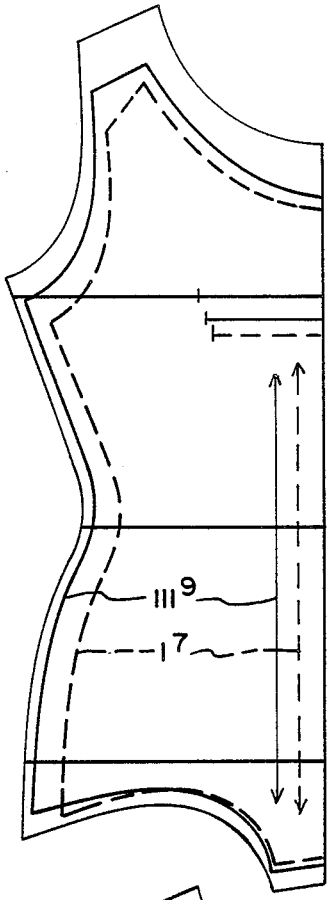
FIGS. 9–12 are lay out views of various stretch patterns in accordance with the present invention with each such stretch pattern being superimposed on the modified pattern of the present invention.
Figure 10:
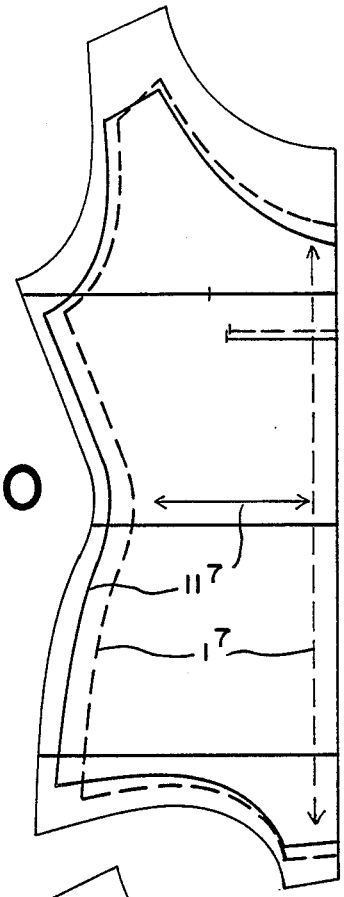
Figure 11:
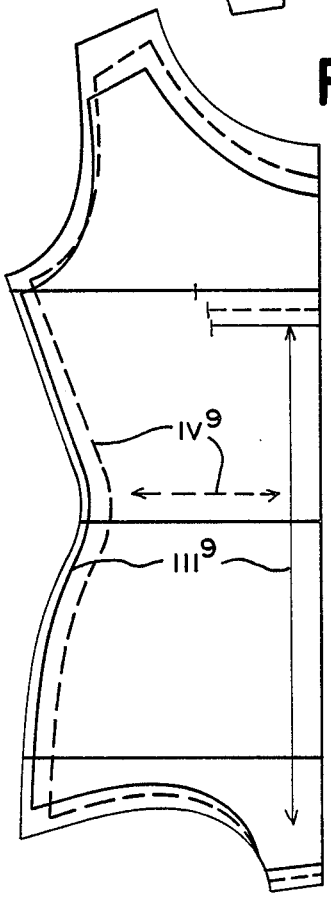
Figure 12:
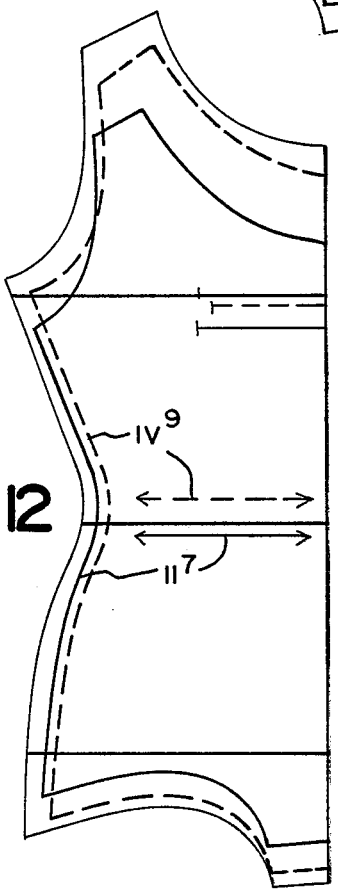

To illustrate the result of applying differing stretch percentages to the grid, patterns cut from fabrics 7 and 9 were superimposed upon one another. FIG. 11, for example, shows how the patterns for garments $III^9$ and $IV^9$ (see Table 2) differ. Garment $III^9$ (bold solid line) was cut with the direction of greatest stretch running around the body, while garment $IV^9$ (dotted line) was cut with the direction of the greatest stretch running along the length of the body. FIGS. 9, 10, and 12 illustrate other combinations of fabric grain direction and stretch percentages taken from Table 2, and applied to the grid on the modified pattern. The greatest variances are always found in the upper torso since two H units are taken out, one above and one below the bust point 134. As can thus be seen, the garment pattern adaptation system in accordance with the present invention results in garment pieces which have significantly varying shapes. However, when finished garments, such as leotards were made using these patterns, all of the garments fit a standard size 10 dress form properly, as determined by a panel of design professionals. When tested on live models, the various garments demonstrated the same fit characteristics and provided non-constricted movement.

The garment pattern adaptation system in accordance with the present invention provides a highly successful way to adapt a pattern originally intended for use with woven, rigid fabrics to a pattern which is useable with knitted elastomeric stretch fabrics in which the particular stretch characteristics of the individual fabric are utilized to arrive at a specific stretch fabric pattern. Body contouring action wearables can then be produced from these stretch patterns and these garments are far superior to those made by utilization of prior systems.

While a preferred embodiment of a garment pattern adaptation system in accordance with the present invention has been set forth fully and completely above, it will be apparent to one of skill in the art that various changes in, for example, the particular stretch fabrics utilized, the types of garments produced, and the like could be made without departing from the true spirit and scope of the subject invention which is accordingly to be limited only by the following claims:

What is claimed is:

1. A garment pattern adaptation system for adapting a woven fabric garment pattern for use with a stretch fabric, said system including:

selecting a particular stretch fabric;

ascertaining individual fabric stretch percentages for said selected fabric in two directions of stretch of said fabric;

utilizing said individual fabric stretch percentages to provide stretch fabric length and width reduction factors;

providing a modified garment pattern;

applying said stretch fabric length and width reduction factors to said modified pattern; and forming a stretch fabric pattern useable with said particular stretch fabric to produce body contouring garments.

2. The garment pattern adaptation system of claim 1 further including ascertaining said individual fabric stretch percentages for a stretch fabric sample having a test size generally equivalent to one quarter of a garment to be produced.

3. The garment pattern adaptation system of claim 2 further including applying a load to a lower portion of said stretch fabric sample and determining an amount of fabric elongation between two benchmarks on said stretch fabric sample.

4. The garment pattern adaptation system of claim 1 further including utilizing an original garment pattern intended for use with rigid woven material and modifying said original pattern by removing body ease and redistributing said original pattern to arrive at said modified pattern.

5. The garment pattern adaptation system of claim 1 further including ascertaining said stretch fabric length reduction factor by determining a total pattern length reduction amount, by reducing said total pattern length reduction amount to allow body ease and by allocating said resultant reduction amount and thereby forming three equal horizontal reduction units.

6. The garment pattern adaptation system of claim 5 including applying said three equal horizontal reduction units to said modified pattern along three horizontal grid lines on said modified pattern.

7. The garment pattern adaptation system of claim 1 further including ascertaining said stretch fabric width reduction factor by determining a half body pattern width reduction amount, by reducing said half body pattern width reduction amount to allow body ease, by dividing said resultant half body width reduction amount into two equal quarter body width reduction amounts and by allocating each said quarter body width reduction amount into unequal larger and smaller width reduction units.

8. The garment pattern adaptation system of claim 7 further including applying said unequal larger and smaller width reduction units to two spaced vertical grid lines on said modified pattern.

* * * * *